United States Patent [19]

Nielsen

[11] 4,165,204

[45] Aug. 21, 1979

[54] SUMP PUMP

[76] Inventor: Axel L. Nielsen, 1316 E. Elza, Hazel Park, Mich. 48030

[21] Appl. No.: 851,842

[22] Filed: Nov. 16, 1977

[51] Int. Cl.[2] ..... F04B 49/04

[52] U.S. Cl. ..... 417/40

[58] Field of Search ..... 417/17, 40, 43, 41, 417/25

[56] References Cited

U.S. PATENT DOCUMENTS

| | | | |
|---|---|---|---|
| 2,550,093 | 4/1951 | Smith | 417/43 |
| 2,625,107 | 1/1953 | Schaefer | 417/40 X |
| 2,810,350 | 10/1957 | MacWilliams | 417/40 X |
| 2,844,678 | 7/1958 | Nielsen | 417/40 X |
| 3,295,450 | 1/1967 | Schonwald et al. | 417/43 |
| 3,540,027 | 11/1970 | Rauth et al. | 417/36 X |
| 3,684,400 | 8/1972 | Einerson et al. | 417/40 |

FOREIGN PATENT DOCUMENTS

| | | | |
|---|---|---|---|
| 301145 | 10/1917 | Fed. Rep. of Germany | 417/17 |

*Primary Examiner*—Carlton R. Croyle
*Assistant Examiner*—Edward Look
*Attorney, Agent, or Firm*—Whittemore, Hulbert & Belknap

[57] ABSTRACT

A sump pump having a float to initiate pumping and a flow-actuated device to continue pumping until the sump is substantially empty. The device may be in the form of a check valve held open by flow during pumping, and having a position which mechanically retains a motor switch closed.

7 Claims, 6 Drawing Figures

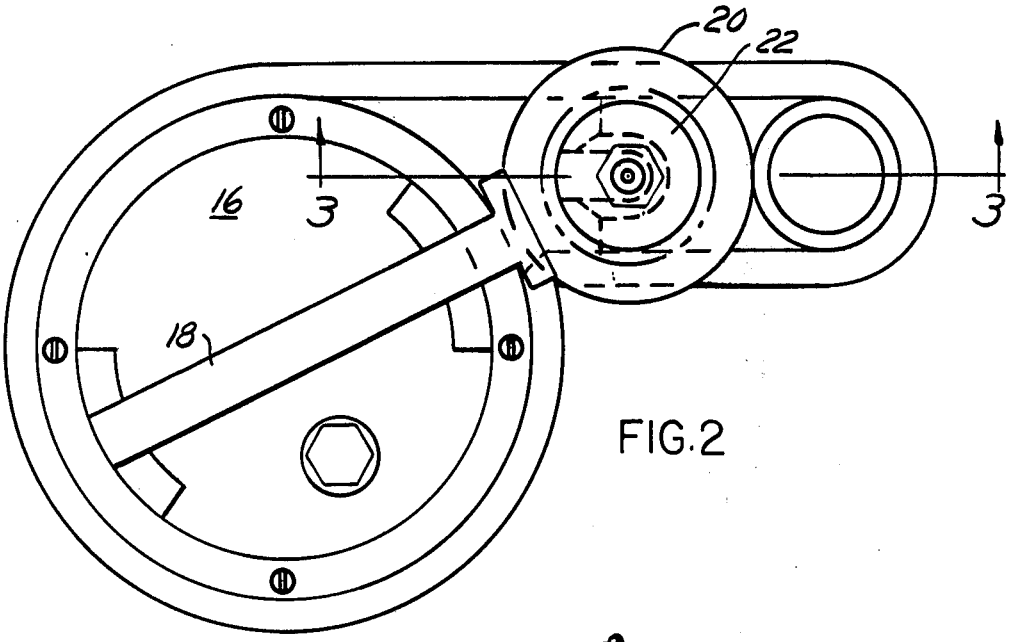
FIG. 2
FIG. 1
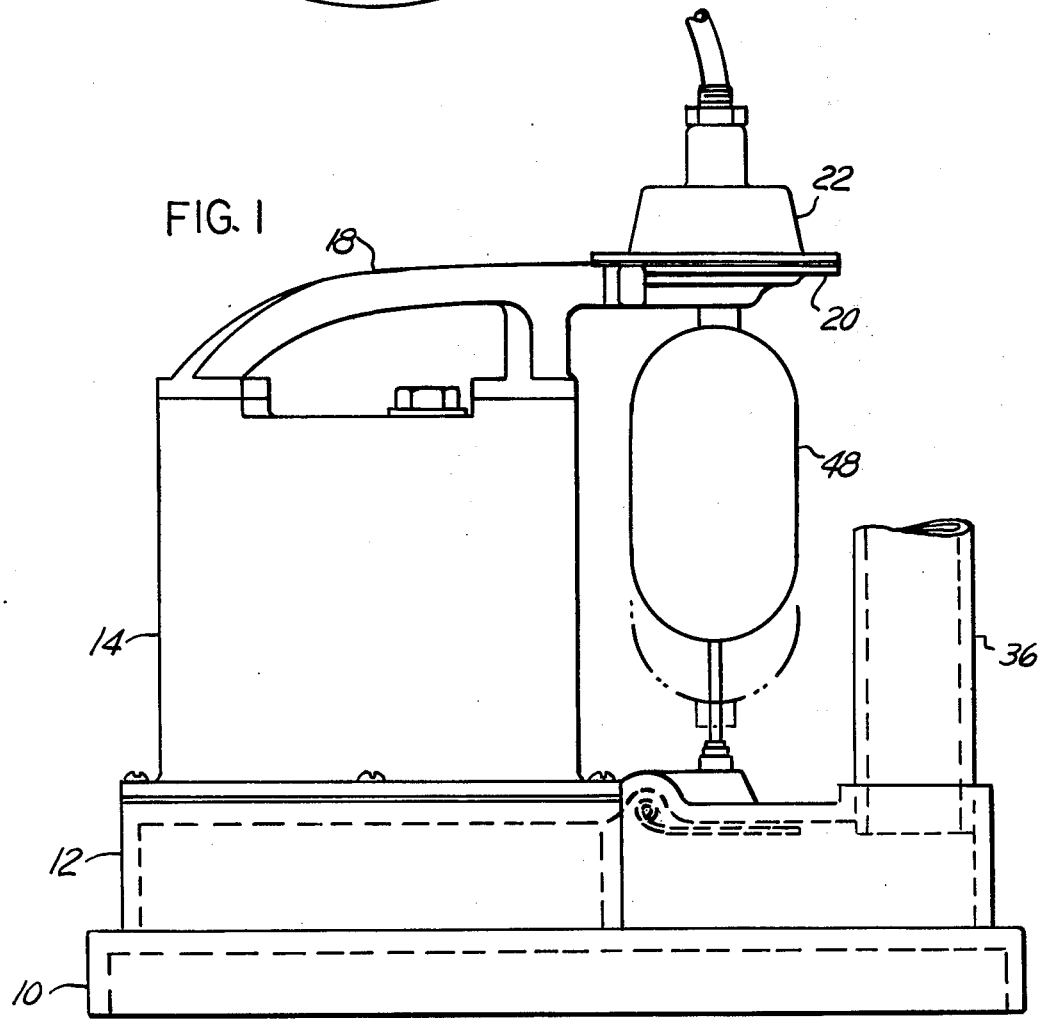

FIG. 3
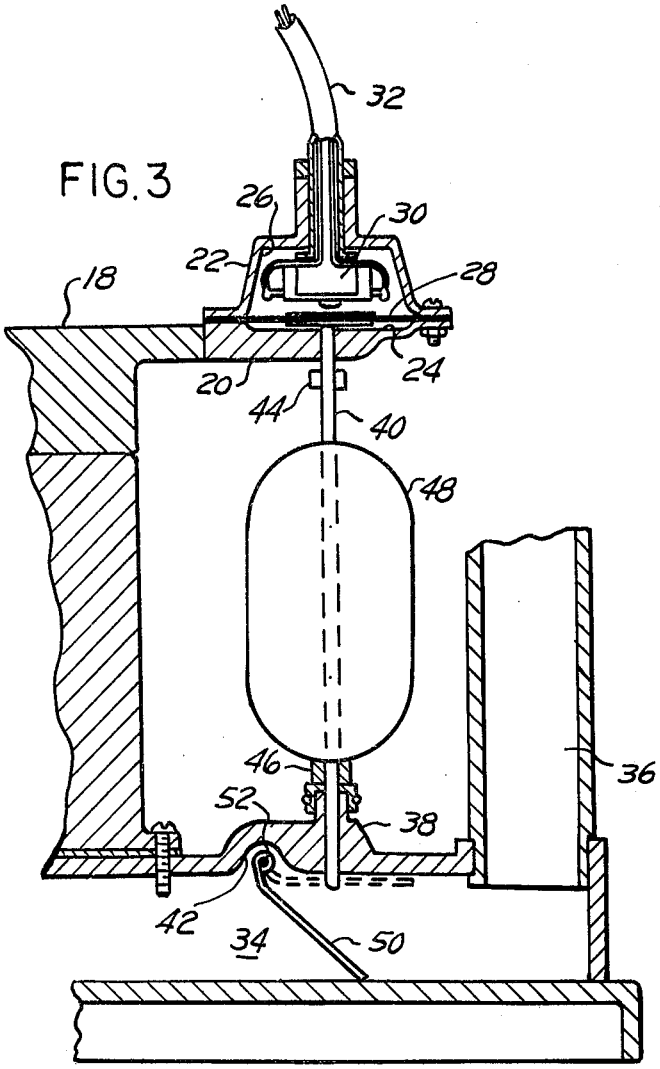
FIG. 4
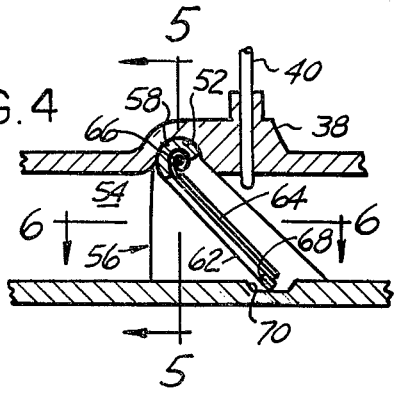
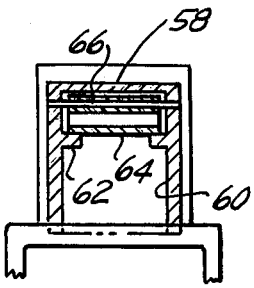
FIG. 5
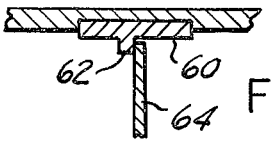
FIG. 6

SUMP PUMP

BRIEF SUMMARY OF THE INVENTION

The present invention relates to a sump pump with a self-contained motor. The motor is in turn controlled by a switch which is moved to closed position by a float to initiate pumping action, but flow-actuated means maintains the switch closed until the sump is empty.

Float controlled of sump pumps has in the past been used, as has pressure responsive diaphragms. In my prior U.S. Pat. No. 2,844,678, there is disclosed a switch for controlling a sump pump motor which is closed by a float to initiate pumping when the water or other liquid in the sump reaches a predetermined level, and which is maintained closed by means responsive to flow of water discharged from the pump. Thus the level of liquid in the sump may be lowered to the pump intake independently of the float.

A prior patent to Schaeffer U.S. Pat. No. 2,625,107 also discloses a complicated and expensive arrangement in which operation of a sump pump is initiated by upward movement of a float which serves as a housing for a submerged motor, the pump operation being continued by means responsive to pressure or flow in the pump outlet line until the sump is emptied.

The present invention is concerned with a submersible self-contained unit in which the pump, motor, and controls are manufactured as a compact, low profile assembly ready for instant installation. Units of this type desirably have an overall height which rarely exceeds 8–10", which makes it difficult to attain a pumping cycle capable of reducing the liquid level in the sump of more than a few inches, using a float activated on-off control. While pressure responsive diaphragm controls have a somewhat greater capability, there is still a substantial preference for float controlled or float initiated operation.

The problems presented in the past by submersible sump pumps and their capability on relatively small differential between the liquid level in the sump at which pumping is initiated and the level at which pumping is discontinued, has been aggravated by flow-back of liquid from the vertical discharge line. In the present sump assembly, a check valve is provided which serves the dual purpose of preventing return of pumped liquid to the sump upon termination of the pumping operation, and of continuing the pump in operation so long as liquid remains in the sump.

The invention is further characterized in a simple, low profile design, in which a handle is provided at the top of the motor housing, and the switch for controlling the motor is mounted on top of the handle to increase vertical travel of the float.

Finally, the present invention provides a chamber in the pump outlet line, into the top of which a movable float actuated switch control rod extends, and which contains a check valve seat and valve assembly in which the check valve engages the control rod to continue a pumping cycle until the sump is substantially empty.

BRIEF DESCRIPTION OF THE DRAWINGS

FIG. 1 is an elevational view of the novel sump pump assembly. 3–3A (at bottom) FIG. 2.

FIG. 2 is a plan view of FIG. 1.

FIG. 3 is a sectional view on the lines 3—3, (at top) and 3–3A (at bottom) FIG. 2.

FIG. 4 is a fragmentary sectional view showing the check valve seat and valve sub-assembly.

FIG. 5 is a fragmentary section on line 5—5, FIG. 4.

FIG. 6 is a fragmentary section on line 6—6, FIG. 4.

DETAILED DESCRIPTION

The submersible unitary sump pump comprises a base 10 suitably formed to provide for flow of liquid from a sump in which the unit is placed from the bottom of the sump into the pump.

The pump 12 may be of convention construction, as for example a centrifugal pump comprising an impeller in a cylindrical pump housing. An electric motor 14 is contained in cylindrical motor housing and include a vertical drive shaft, not shown, which connects to the pump impeller.

The top of the motor housing is provided with a sealed top closure 16 and is further provided with a carrying handle 18 by which the complete pumping unit may be carried and positioned in the sump.

A switch housing comprises lower portion 20 secured to handle 18 to constitute a lateral extension thereof, and mounted on the upper surface of housing portion 20 is a sealed switch housing cover 22. The portion 20 is recessed as at 24, and the housing 22 includes a downwardly open switch containing cavity 26. Between the peripheral portions of recess 24 and cavity 26 is a flexible diaphragm 28. Within the cavity 26 is a switch 30, having as illustrated a depending actuating button which when raised closes the switch. The switch is suitably connected by electrical connections indicated at 32 to control the motor 14. The pump 12 comprises an outlet chamber 34 which receives the bottom end of vertical pump discharge conduit 36. The upper wall of the chamber includes a thickened portion 38 having a vertical opening which slidably receives a rod 40. The thickened wall portion 36 also is provided at its underside with a transversely extending downwardly open recess 42.

The upper end of rod 40 extends through portion 20 and into the recess 24, where it is adjacent to or in contact with the diaphragm 28 when the diaphragm is spaced downwardly from the button switch 30. The rod is provided with fixed abutments 44 and 46. The abutment 46 limits downward movement of the rod when it is not held up in switch closing position by liquid level in the sump or by discharge flow from the pump.

A float 48 is vertically slidable on rod 40, and when the liquid in the sump reaches a predetermined level, the float engages stop 44 and further upward movement of the float moves the rod upwardly and closes switch 30.

As best seen in FIG. 5, the chamber 34 through which liquid is pumped is rectangular in cross-section. A flow responsive leaf 50 is suspended by a pivot pin 52 within the chamber 34 as seen in FIG. 3. When the pump motor is energized by switch 30, the leaf 50 is swung by the flow of liquid to the dotted line position in which it prevents downward movement of switch actuating rod 40 so long as the pump is discharging liquid. However, when the liquid level reaches the pump intake, flow stops, leaf 50 returns to its full line position, rod 40 drops and switch 30 is opened, terminating the pumping cycle.

As illustrated in FIGS. 4–6, the leaf preferably constitutes part of a check valve and valve seat sub-combination, insertible as a unit into the chamber, here designated 54. A valve seat member 56 having a curved top edge 58 seated in the transverse recess 52 has side walls 60 provided with inclined flanges 62 which constitute seat portions for the combined pivoted check valve and switch rod retainer, here designated 64. The check valve 64 is mounted on a pivot pin 66, the ends of which are retained in openings in the side walls 60 of member 56. The side walls 60 of the member 56 are joined at the bottom by an integral strip 68. The material of member 56 is preferably resilient, and may be a suitable plastic material. This serves to provide an effective seal when check valve 64 seats against the element, but also permits the valve and valve seat sub-combination to be inserted as a unit into chamber 54, with the curved edge 58 seated in the recess 52, the side walls 60 received in complementary recesses as seen in FIG. 6, and the transverse bottom portion 68 received in recess 70.

What I claim as my invention is:

1. A sump pump assembly comprising a pump, a discharge passage for pumped liquid connected to said pump, an electric motor operatively connected to said pump, a switch for controlling said motor, a float device comprising an element movable upwardly in response to rising liquid level in the sump and operable thereby to close said switch, and a leaf movably mounted in said discharge passage for movement by the flow of pumped liquid therein to a position in which it engages said element and prevents return of said element to switch opening position, said element comprising a vertical switch actuating rod, spaced abutments on said rod, a float slidable vertically on said rod between said abutments, the lower end of said rod being vertically movable within said discharge passage in position to be engaged by said leaf and retained in upper switch-closing position by said leaf.

2. A sump pump assembly comprising a pump, a discharge passage for pumped liquid connected to said pump, an electric motor operatively connected to said pump, a switch for controlling said motor, a float device comprising an element movable upwardly in response to rising liquid level in the sump and operable thereby to close said switch, and a leaf movably mounted in said discharge passage for movement by the flow of pumped liquid therein to a position in which it engages said element and prevents return of said element to switch opening position, said element comprising a vertical switch actuating rod, spaced abutments on said rod, a float slidable vertically on said rod between said abutments, the lower end of said rod being vertically movable within said discharge passage in position to be engaged by said leaf and retained in upper switch-closing position by said leaf, in which said pump is located substantially at the bottom of said assembly, said motor is directly above said pump, a handle atop said motor, said handle has a lateral extension beyond one side of said pump and motor, said discharge passage extends horizontally from the said one side of said pump, said switch is mounted on the lateral extension of said handle overlying said discharge passage and leaf, and said float device comprises a switch actuating rod extending vertically between said switch and said passage, and a float on said rod.

3. A sump pump assembly comprising a pump, a discharge passage for pumped liquid connected to said pump, an electric motor operatively connected to said pump, a switch for controlling said motor, a float device comprising an element movable upwardly on said assembly in response to rising liquid level in the sump and operable thereby to close said switch, a check valve movable mounted in said discharge passage for movement by the flow of pumped liquid therein to a position in which it engages said element and prevents return of the element to switch opening position, said switch being located above said discharge passage, said float device comprising a rod constituting said element movable vertically between said switch and said passage and having its lower end projecting into said passage when said rod is in its lower position, a float slidable on said rod between fixed abutments thereon, said check valve in open position being engageable with the lower end of said rod to prevent movement of said rod to switch opening position.

4. A pump as defined in claim 3, comprising a housing support for said switch including a flexible diaphragm, said switch including an actuator in position to be engaged by said diaphragm on inward flexing thereof, said rod being engageable with said diaphragm on upward movement of said rod, said diaphragm being inwardly movable by fluid pressure in the event of failure of said float and rod to operate said switch.

5. A sump pump, a discharge passage connected to said pump, a check valve in said passage movable from a closed position by discharge flow from said pump to an open position, switch means controlling the operation of said pump, said valve being operable in open position to prevent opening of said switch to terminate pump operation while discharge flow from said pump continues, said discharge passage comprising a chamber, a valve seat member removably positioned in said chamber, said valve being pivotally connected to said valve seat member for insertion as a unit therewith into said chamber.

6. A pump as defined in claim 5, said chamber and valve seat member being of rectangular cross section.

7. A pump as defined in claim 6, said valve seat member having a rectangular opening and said valve being rectangular to conform to said opening.

* * * * *